US006850403B1

(12) United States Patent
Gefter et al.

(10) Patent No.: US 6,850,403 B1
(45) Date of Patent: Feb. 1, 2005

(54) AIR IONIZER AND METHOD

(75) Inventors: Peter Gefter, South San Francisco, CA (US); Alexander Ignatenko, Hayward, CA (US); Gopalan Vijaykumar, Fremont, CA (US); Aleksey Klochkov, San Francisco, CA (US)

(73) Assignee: Ion Systems, Inc., Berkeley, CA (US)

( * ) Notice: Subject to any disclaimer, the term of this patent is extended or adjusted under 35 U.S.C. 154(b) by 219 days.

(21) Appl. No.: 10/238,400

(22) Filed: Sep. 9, 2002

Related U.S. Application Data

(60) Provisional application No. 60/337,418, filed on Nov. 30, 2001.

(51) Int. Cl.[7] ..... H01T 23/00
(52) U.S. Cl. ..... 361/230; 361/225
(58) Field of Search ..... 361/230, 231, 361/233, 212, 213, 225

(56) References Cited

U.S. PATENT DOCUMENTS

| | | | |
|---|---|---|---|
| 769,055 | A | 8/1904 | Bumgardner |
| 2,023,321 | A | 12/1935 | Gutman |
| 2,264,495 | A | 12/1941 | Wilner |
| 2,589,613 | A | 3/1952 | Hicks |
| 2,723,349 | A | 11/1955 | Ryisky |
| 2,785,312 | A | 3/1957 | Martin, Jr. |
| 2,834,898 | A | 5/1958 | Partridge |
| 2,847,324 | A | 8/1958 | Ogint |
| 2,928,941 | A | 3/1960 | Hicks et al. |
| 3,120,626 | A | 2/1964 | Schweriner |
| 3,137,808 | A | 6/1964 | Schweriner |
| 3,156,847 | A | 11/1964 | Schweriner |
| 3,263,127 | A | 7/1966 | Point et al. |
| 3,308,343 | A | 3/1967 | Smith et al. |
| 3,335,272 | A | 8/1967 | Dickinson et al. |
| 3,337,784 | A | 8/1967 | Lueder |
| 3,395,042 | A | 7/1968 | Herbert, Jr. |
| 3,403,252 | A | 9/1968 | Nagy |

(List continued on next page.)

FOREIGN PATENT DOCUMENTS

| | | |
|---|---|---|
| CA | 1 140 629 | 2/1983 |
| DE | 2234228 | 3/1973 |
| EP | 0 844 726 A2 | 5/1998 |
| GB | 1 540 342 | 2/1979 |
| WO | WO 98/21791 | 5/1998 |

OTHER PUBLICATIONS 3m 724 Work Station Monitor Instructions, Electronic Handling & Protection Division, pp. 3–21; © 3M 1998.
961 Ionized Air Blower, 3M Electrical Specialties Division.
A Laminar Flux Hood Neutralizer With A Reduced Residual Voltage, Inst. Phys. Conf. Ser. No. 85; Section 2—paper presented at Electrostatics '87, Oxford, © 1887 10P Publishing Ltd., pp. 171–176.
D. W. Moeller, S.N Rudnick & E.F. Maher, Laboratory And Field Tests Of A Hassock Fan–Ion Generator Radon Decay Product Removal Unit; Oct., 1987.
Metaphysical Home Page of John & Micki Baumann re: Sedona, Arizona; clifcom©1996, 1997.

*Primary Examiner*—Gregory J. Oatley, Jr.
*Assistant Examiner*—James Demakis
(74) *Attorney, Agent, or Firm*—Fenwick & West LLP

(57) ABSTRACT

Apparatus and method for generating and controlling flows of positive and negative air ions includes interposing isolated sets of electrodes in a flowing air stream to separately produce positive and negative ions. The rates of separated production of positive and negative ions are sensed to control ionizing voltages applied to electrodes that produce the ions. Variations from a balance condition of substantially equal amounts of positive and negative ions flowing in the air stream are also sensed to alter bias voltage applied to a grid electrode through which the air stream and ions flow.

15 Claims, 9 Drawing Sheets

U.S. PATENT DOCUMENTS 3,417,302 A 12/1968 Lueder
3,443,155 A 5/1969 Schweriner
3,504,227 A 3/1970 Wooton et al.
3,582,711 A 6/1971 Jahnke
3,624,448 A 11/1971 Saurenman
3,654,534 A 4/1972 Fischer
3,711,743 A 1/1973 Bolasny
3,816,799 A 6/1974 Ott et al.
3,853,512 A 12/1974 Hayashi
3,873,835 A 3/1975 Ignatjev
3,936,698 A 2/1976 Meyer
4,092,543 A 5/1978 Levy
4,156,267 A 5/1979 Spaulding et al.
4,188,530 A 2/1980 Miller
4,194,232 A 3/1980 Cumming et al.
4,213,167 A 7/1980 Cumming et al.
4,216,518 A 8/1980 Simons
4,253,852 A 3/1981 Adams
4,258,408 A 3/1981 Cantelli
RE30,826 E 12/1981 Laws
4,317,661 A 3/1982 Sasaoka
4,319,302 A 3/1982 Moulden
4,333,123 A 6/1982 Moulden
4,351,648 A 9/1982 Penney
4,363,072 A 12/1982 Coggins
4,366,525 A 12/1982 Baumgartner
4,370,695 A 1/1983 Penick
4,438,479 A 3/1984 Schwartz et al.
4,440,553 A 4/1984 Helmus et al.
4,473,382 A 9/1984 Cheslock
4,496,375 A 1/1985 Le Vantine
4,498,116 A 2/1985 Saurenman
4,502,091 A 2/1985 Saurenman
4,528,612 A 7/1985 Spengler
4,536,698 A 8/1985 Shevalenko et al.
4,542,434 A 9/1985 Gehlke et al.
4,596,585 A 6/1986 Moeller et al.
4,630,167 A 12/1986 Huggins
4,635,161 A 1/1987 Le Vantine
4,642,728 A 2/1987 Unger
4,682,266 A 7/1987 Huynk et al.
4,689,715 A 8/1987 Halleck
4,729,057 A 3/1988 Halleck
4,740,862 A * 4/1988 Halleck ..... 361/231
4,750,080 A 6/1988 Cumming et al.
4,757,421 A 7/1988 Mykkanen
4,757,422 A 7/1988 Bossard et al.
4,768,126 A 8/1988 Le Vantine
4,774,472 A 9/1988 Blitshteyn et al.
4,805,068 A 2/1989 Cumming et al.
4,809,127 A 2/1989 Steinman et al.
4,827,371 A 5/1989 Yost
4,864,459 A 9/1989 Larigaldie et al.
4,872,083 A 10/1989 Blitshteyn
4,901,194 A 2/1990 Steinman et al.
4,951,172 A 8/1990 Steinman et al.
4,980,796 A 12/1990 Huggins
5,008,594 A 4/1991 Swanson et al.
5,010,777 A 4/1991 Yehl et al.
5,017,876 A 5/1991 Wright et al.
5,055,963 A 10/1991 Partridge
5,057,966 A 10/1991 Sakata et al.
5,150,273 A 9/1992 Le Vantine
5,153,811 A 10/1992 Rodrigo et al.
5,359,319 A 10/1994 Campbell et al.
5,359,750 A 11/1994 Le Vantine
5,422,630 A 6/1995 Quinn et al.
5,432,454 A 7/1995 Durkin
5,532,902 A 7/1996 Beyer et al.
5,535,089 A 7/1996 Ford et al.
5,612,849 A 3/1997 Prehodka et al.
5,707,429 A 1/1998 Lewis
5,930,105 A 7/1999 Pitel et al.
6,002,573 A 12/1999 Partridge
6,130,815 A * 10/2000 Pitel et al. ..... 361/212
6,137,670 A 10/2000 West et al.
6,259,591 B1 7/2001 Pitel et al.
6,674,630 B1 * 1/2004 Gefter et al. ..... 361/212

* cited by examiner

AIR IONIZER AND METHOD

RELATED APPLICATIONS

This application claims of benefit of priority from provisional application Ser. No. 60/337,418 entitled "Mini-Ionizing Fan", filed on Nov. 30, 2001 by P. Gefter et al.

FIELD OF THE INVENTION

This invention relates to compact apparatus for rapidly neutralizing electrostatic charges on objects, and more particularly to apparatus and methods for producing and delivering an air stream of electrically balanced positive and negative ions.

BACKGROUND OF THE INVENTION

Contemporary fabrication processes for semiconductor devices and other electronic components commonly rely upon robotics and automatic transfer mechanisms for transporting wafers or other substrates between fabrication processing stations. Such transfer mechanisms are accompanied by electrostatic charging of the wafers or substrates associated, for example, with contacting and separating from other components (triboelectric effect). Accumulated electrostatic charges attract contaminants from ambient air and can also cause damaging electrostatic discharges within microchip circuits or other fabricated electronic components. One effective protective measure is to neutralize electrostatic charges using an air stream of positive and negative ions directed to the charged object. Ideally, balanced quantities of positive and negative ions are supplied to the object to avoid charging the object on the unbalanced excessions of one polarity.

Self-balancing production of positive and negative ions requires excellent insulation from ground of the high-voltage supplies and minimum leakage of ionization currents. These requirements conventionally result in bulky apparatus having large separations between ionizing electrodes of opposite polarities, and requiring high-voltage supplies of large dimensions capable of delivering 15–20 kilovolts of air-ionizing potential.

SUMMARY OF THE INVENTION

In accordance with one embodiment of the present invention, miniaturized apparatus including a small fan and closed-loop feedback systems control the supplies of bipolar ionizing voltages to produce balanced streams of positive and negative air ions. Audible and visual alarms are activated upon occurrence of diminished performance below established parameters. Alternatively drive signals for alarms are used to control production and flow of ions in an air stream. The miniaturized configuration of the present invention facilitates mounting on a robotic arm or manipulator to rapidly discharge a charged object from close range, commonly as part of robotic movement to transport the wafer or substrate. This promotes higher speed production aided by well-directed supplies of balanced ions for more complete, rapid discharge of a charged object. In addition, current monitoring systems respond to ion output and provide output alarm indications of ion balance and ionization efficiency, and the like. Also, closed loop control of the ionizing supplies provide stable, balanced ion production over a wide range of operating conditions. High voltages applied to ionizing electrodes and bias voltage applied to a grid electrode create and control the supplies of air ions that are delivered in close proximity to a charged object via an air stream from the miniature fan. Electrode erosion and contamination and ambient air conditions that may adversely affect ion production can be compensated by sensor circuitry that alters the voltage levels of the ionizing voltage supplies to compensate for the changed operating conditions and thereby maintain a reliable, stable rate of ion production from the positive and negative ionizing electrodes.

DETAILED DESCRIPTION OF THE INVENTION

Figure 1:
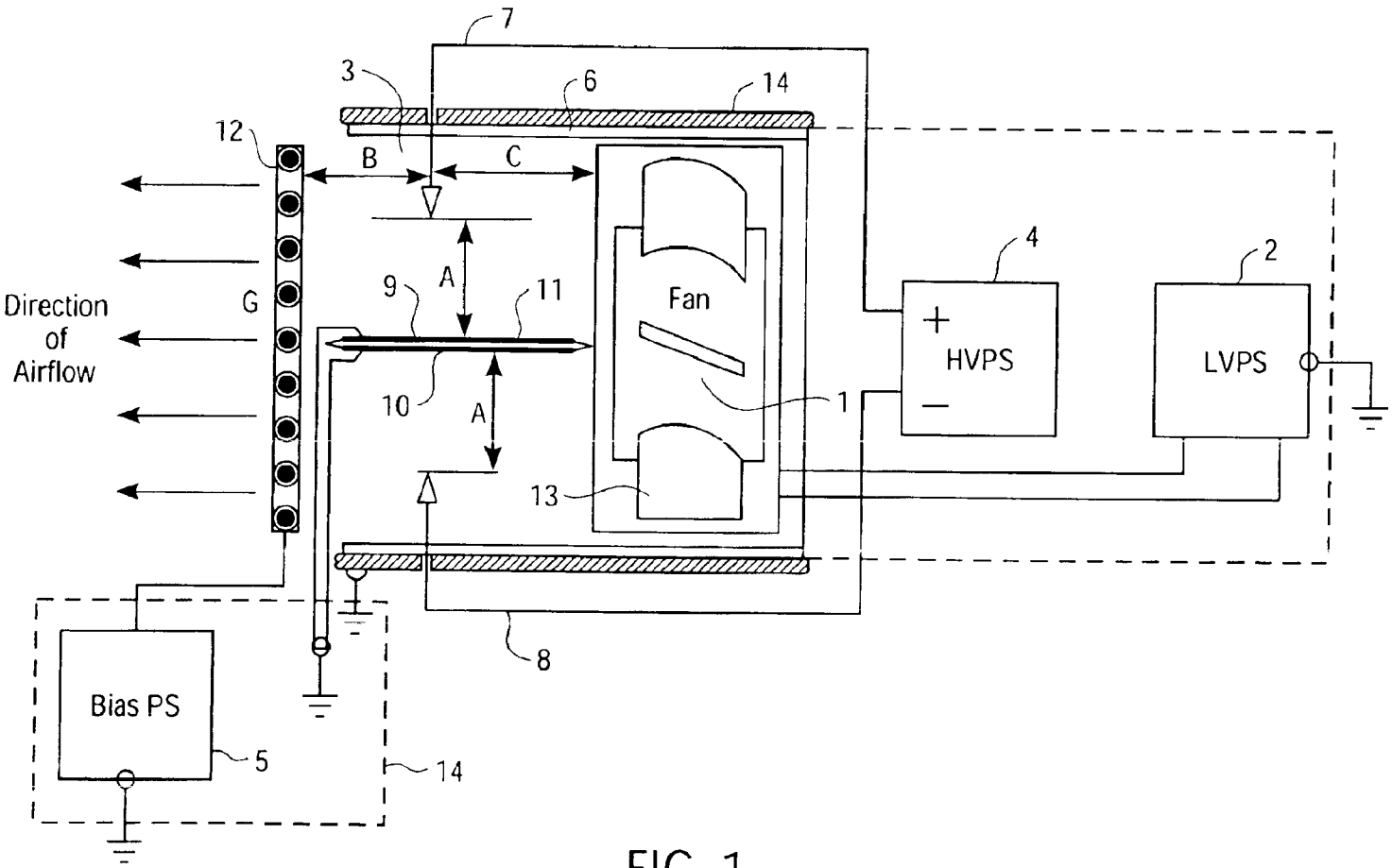
FIG. 1 is a pictorial illustration of one embodiment of the present invention.

Referring now to the pictorial illustration of FIG. 1, there is shown one embodiment of the present invention including a miniature fan 1 disposed near the inlet of duct 6 to move air through the substantially cylindrical duct 6 past the electrodes 7–10 and grid 12. The fan 1 is powered by low-voltage power supply 2, and the ionizing electrodes 7, 8 are connected to the high-voltage supply 4. The grid electrode 12 is connected to low voltage bias supply 5. The fan 1 creates a flow of air of about 3CFM through the duct 6 of cylindrical shape that is formed of, or is coated with, electrically insulating material over the length thereof from the fan 1, through the region 3 of ion generation, to the outlet adjacent the grid 12. An external conductive layer 14 is connected to ground to electrostatically shield the assembly.

The region 3 of ion generation includes pointed electrodes 7, 8 connected to positive and negative high voltages from supply 4. The electrodes 7, 8 intrude from opposite walls in alignment across the duct 6. These electrodes 7, 8 are well insulated from ground at a resistance of $10^{12}$ ohms, or higher to minimize leakage currents. A pair of thin, planar, conductive electrodes 9, 10 are separated by a thin layer of insulation 11 with knife edges at least facing the air flow from fan 1. These electrodes 9, 10 are disposed as a septum substantially across a diameter of the duct 6 normal to the aligned axes of the electrodes 7, 8 and aligned with the flow of air through the duct 6. In addition, grid electrode 12 is disposed across the outlet of duct 6 perpendicular to, and insulated from, the planar septum electrodes 9, 10. The grid electrode 12 is connected to receive low bias voltage from bias supply 5 for operation as later described herein. This configuration of electrodes 7–10 and grid 12 provides physical and electrical separation of the components generating positive and negative ions in the respective regions of the duct 6, all within the air stream from fan 1.

Positive and negative coronas produced by respective electrodes 7, 8 to the adjacent planar septum electrodes 9, 10 generate stable amounts of positive and negative ions in response to high voltages applied to the electrodes 7, 8. These high voltages are applied at different levels by the power supply 4 in order to generate substantially equal quantities of positive and negative ions per unit time. As is commonly known, negative ions have greater mobility and are more readily created in air than positive ions under comparable ion-generating conditions. For this reason, to generate substantially equal amounts of positive and negative ions, the voltages applied to the ionizing electrodes 7, 8 are different for similar surrounding geometries of components in the region 3 of ion generation. Typically, the voltages levels applied to the ionizing electrodes 7, 8 may be in the ratio of about 1.1–1.8, and typically about 1.3, more positive in order to generate substantially equal amounts of positive and negative ions downstream of fan 1. The high voltage supply 4 is well insulated from ground at resistance in excess of $10^{12}$ ohms to provide 'floating' positive and negative outputs connected to the ionizing electrodes 7, 8. Accordingly, if excessive amounts of negative ions are produced beyond balance condition, then the floating power supply will accumulate additional positive charges that bias the outputs toward producing fewer negative ions. Similar self balancing operation occurs if excessive amounts of positive ions are produced beyond balance condition.

Self balancing generation of ions, as described above, is not adequately effective to attain accurate balance of positive and negative ions below about ±50 volts of charge (or latent discharge) of a target object. The grid 12 disposed at the output of duct 6 and connected to the bias power supply 5 provides the finer balance adjustments required to attain balance within a few volts. The grid 12 is formed as a mesh of wires about 0.02" in diameter, spaced about 0.25" apart along orthogonal axes to allow dominant portions of generated ions to pass through in the flowing air stream from fan 1. The grid 12 thus configured and positioned controls ion balance using low bias voltages, and also screens a target object from the high electrostatic fields within the region 3. The grid 12 is positioned in close proximity to the downstream edges of the septum electrode structure 9–11, at a distance B from the ionizing electrodes 7, 8 which are spaced a distance A from the septum electrodes 9–11. The ratio A/B of the distances should be in the range of about 1.01–1.5, and preferably about 1.3 to provide ion balance adjustment with minimum voltage applied to the grid 12. The ionizing electrodes 7, 8 are also spaced a distance C from conductive elements of the fan 1 and the ratio of distances A/C should be in the range of about 1.5–2.0, and preferably about 1.8 to avoid significantly decreasing the outward flow of ions from ionizing electrodes 7, 8.

The electrodes 7, 8 are formed of thin tungsten wire of about 0.010–0.012" diameter with chemically-etched tip radius of about 0.001" to promote stable corona discharge at low ionizing voltage, with minimum electroerosion and resultant particulate contamination. The fan 1 and power supplies 2, 4, and 5 and the length of duct 6 are enclosed and electrically shielded by a conductive, grounded layer or coating 14 that confines electrostatic and dynamic electromagnetic fields associated with the enclosed components.

Figure 2:
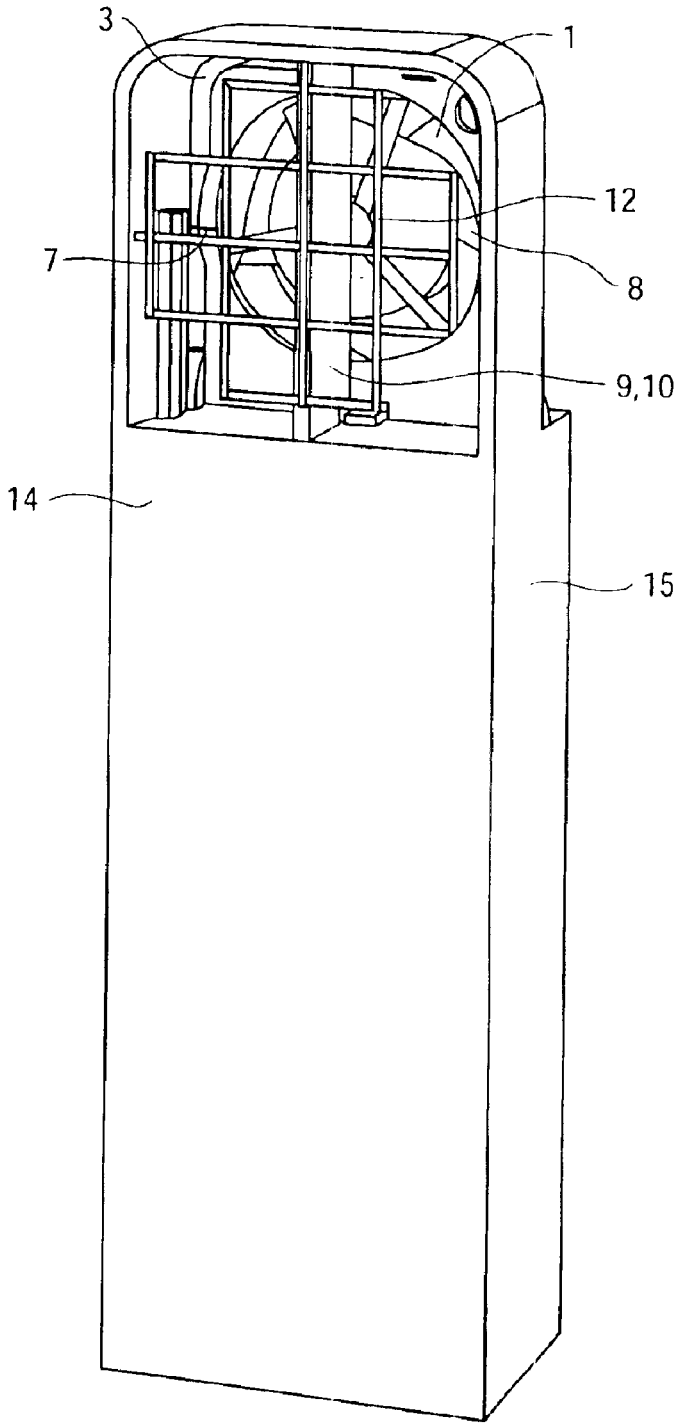
FIG. 2 is an illustration of one embodiment of the present invention.

Referring now to FIG. 2, there is shown one physical embodiment of the present invention within a casing 15 of insulating material that includes a conductive, grounded outer layer or coating for effective shielding. The assembly is sufficiently small to be mounted on robotic transports for semiconductor wafers in order to neutralize static charges thereon via closely-proximate 'spot' treatments for highly effective, targeted charge neutralization.

Figure 3:
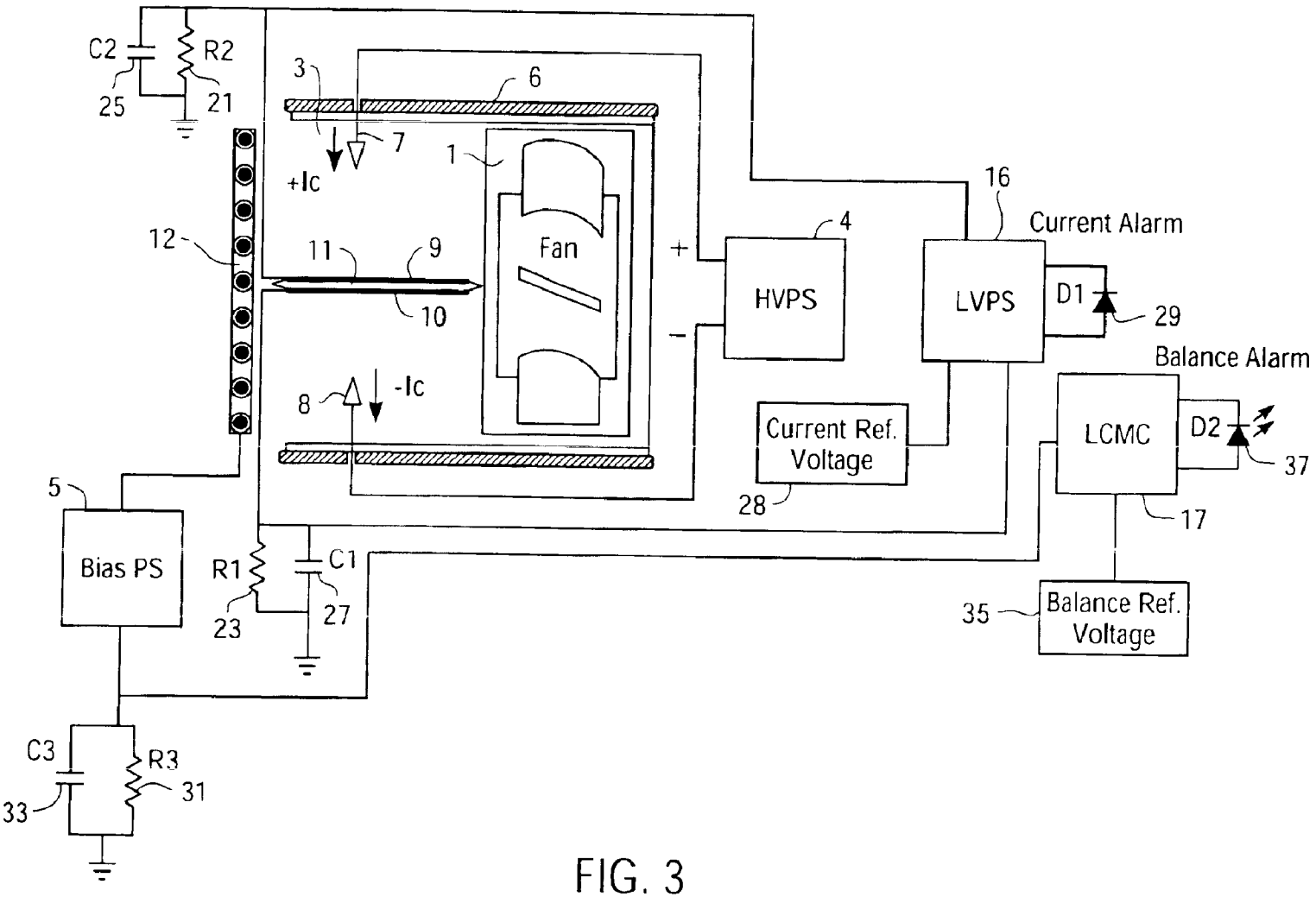
FIG. 3 is a schematic diagram of current monitoring circuitry according to the present invention.

Referring now to the block schematic diagram of FIG. 3, there is shown a monitoring system in accordance with one embodiment of the present invention for continuously measuring positive and negative ion currents and ion balance from the region 3 of ion generation. Specifically, the septum electrodes in the assembly 9, 10, 11 are separately connected to ground through sampling resistors 21, 23 that are each shunted by filtering capacitors 25, 27. High voltages applied to the ionizing electrodes 7, 8 (of the order of about 5–8 kilovolts) produce ions that flow toward the respective septum electrode 9, 10. However, a significant portion of the generated ions are carried away laterally on the air stream from fan 1 through the grid 12 to a nearby target object (not shown). Current flowing through sampling resistor 21 constitutes the positive component of the ion flow ($+I_c$) reaching the electrode 9, and similarly, current flowing in the sampling resistor 23 constitutes the negative component of the ion flow ($-I_c$) reaching electrode 10. The voltage drops on the resistors 21, 23 are monitored by the current monitoring circuit 16 against a reference level 28 to produce a suitable alarm (e.g. drive signal to LED) 29 indicative of a condition of excess ion current flowing through one of the electrodes 9, 10.

Another sampling resistor 31 connects the bias voltage supply 5 to ground to produce a voltage thereacross indicative of an excess of positive or negative ions flowing through, and captured by, the grid 12. This voltage drop, filtered by shunt capacitor 33 is measured against a reference voltage level 35 by the low-current monitoring circuit 17 to produce a suitable alarm (e.g. drive signal to LED 37). In this manner, excess production of positive or negative ions and balance of positive and negative ions delivered at the output of the duct 6 are readily monitored.

Figure 4:
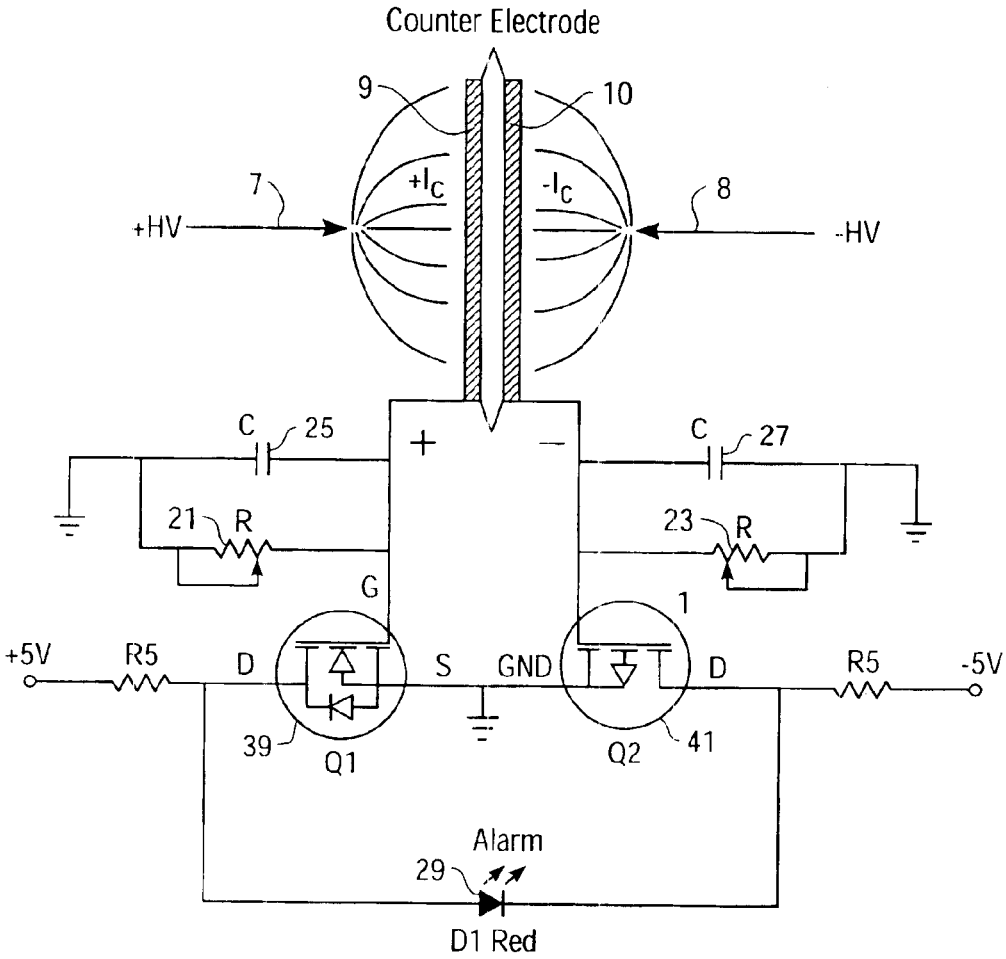
FIG. 4 is a schematic diagram of ion current monitoring circuitry according to the present invention.

Referring now to FIG. 4, there is shown a pictorial diagram of the ion current monitoring circuitry in the embodiment of FIG. 3. Specifically, two TMOSFET's 39, 41 (i.e. N-channel 39 in enhancement mode, and P-channel 41 in enhancement mode) are connected to the sampling resistors 21, 23 as shown. In operation, for positive and negative corona currents close to normal values (typically about 1–3 microamps), the voltage drops on the sampling resistors keep both TMOSFET's 39, 41 biased to open condition, and resultant differential zero voltage drops to ground provide no drive signal to LED 29. However, if for some reason one of the corona currents ($+I_c$; $-I_c$) drops below selected values, then the corresponding one of the two TMOSFET's 39, 41 becomes biased to the closed condition. As a result, differential voltage drops to ground across the TMOSFET's 39, 41 produces drive signal suitable for activating LED 29 to provide a visual (or other) alarm indication of the need for change or cleaning of the electrodes 7, 8, or for readjustment of the high voltage power supplies 4. Different threshold levels can be established for activating such alarm conditions, for example, by providing adjustable sampling resistors 21, 23.

Figure 5:
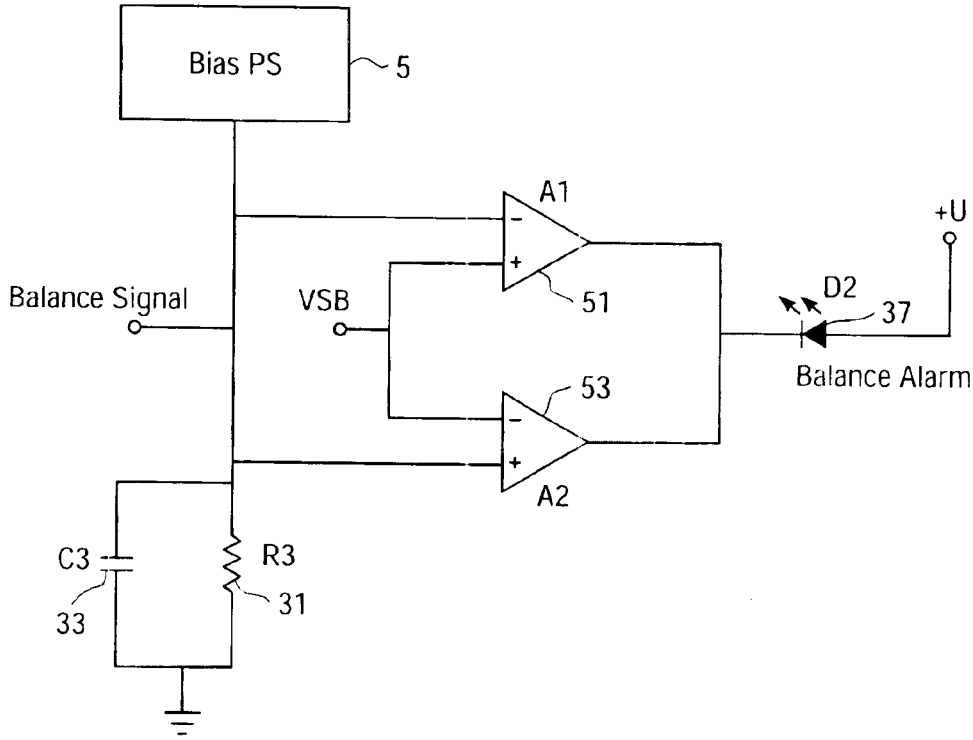
FIG. 5 is a block schematic diagram of ion-balance monitoring circuitry according to the present invention.

Referring now to the block schematic diagram of FIG. 5, there is shown an ion balance monitoring circuitry in accordance with one embodiment of the present invention. Two differential high-gain amplifiers 51, 53 are connected to respond to the voltage drop across the current-sampling resistor 31 (in FIG. 3) relative to the reference voltage $V_{SB}$.

As the voltage across the sampling resistor 31 varies more positive or more negative than the reference voltage $V_{SB}$, one or other of the amplifiers 51, 53 produces an output that activates the LED 37, or other alarm indicator. Such output or alarm indication is representative of the unbalanced status of the ion flow through grid 12, as shown in FIG. 3. The alarm level may be established by adjustment of the reference voltage level, or selection of the sampling resistance 31, or the like.

Figure 6:
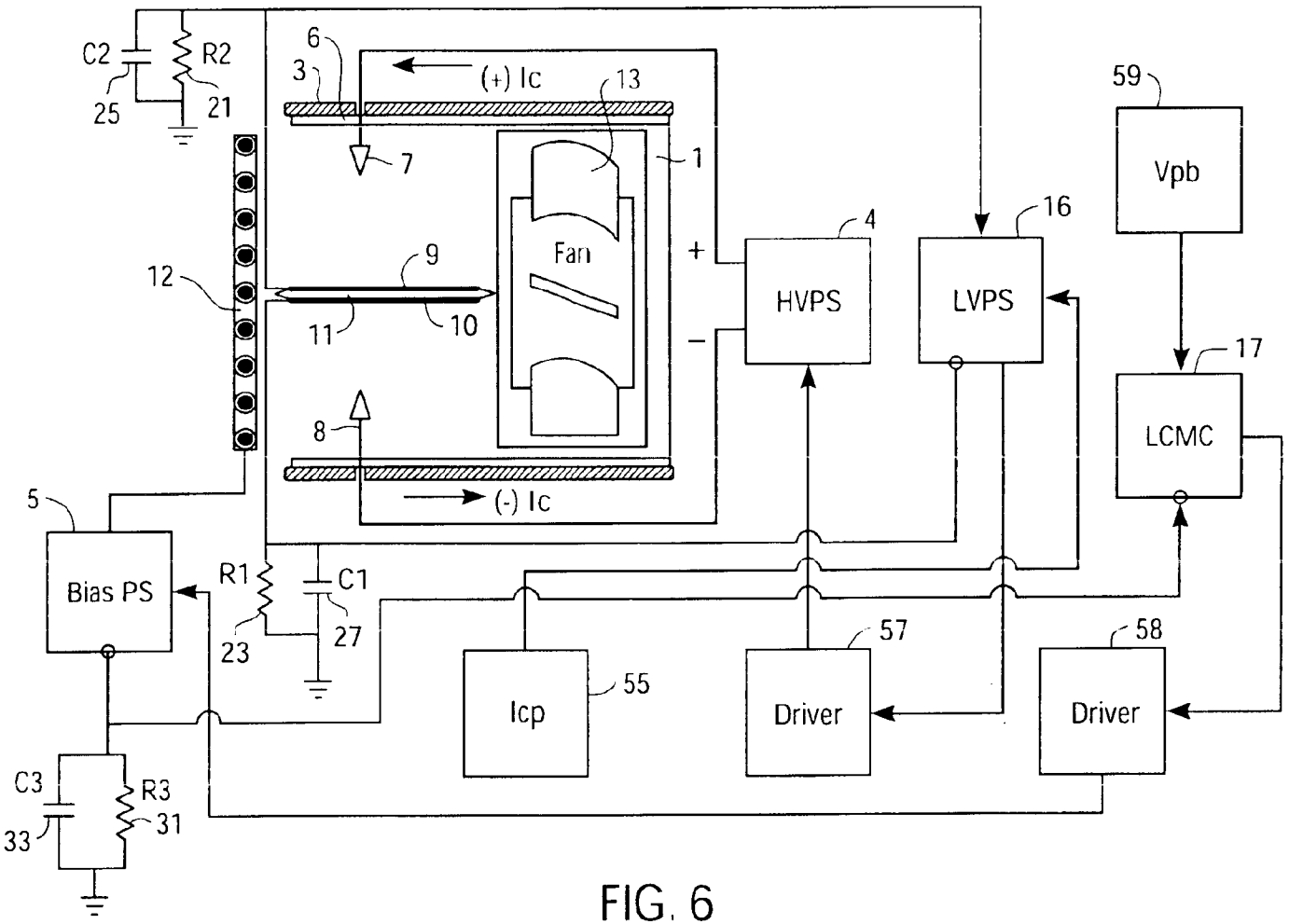
FIG. 6 is a block schematic diagram of closed-loop automatic ion current balancing circuitry according to the present invention.

Referring now to FIG. 6, there is shown a block schematic diagram of another embodiment of the present invention including automatic, active-control schemes based upon continuous monitoring of ion currents. Specifically, the current monitoring circuit (CMC) 16 continuously compares the voltage drops across the sampling resistors 21, 23 with ± set point values from reference supply 55 to determine whether the ± ion currents are within selected ranges of values. In the event that the $+I_c$ ion current, for example, deviates out of tolerable range, the CMC 16 generates a drive signal 57 that controls the output voltage from high voltage power supply 4 in a direction to return the $+I_c$ current to within tolerable range limits. Similarly, in the event that the $-I_c$ current deviates out of tolerable range, the CMC 16 generates a drive signal 57 that controls the output voltage from the high voltage power supply 4 in a direction to return the $-I_c$ current to within tolerable range limits.

In similar manner, the low-current monitoring circuit (LCMC) 17 monitors the voltage drop across the sampling resistor 31 as an indication of the balance status of positive and negative ions flowing through the screen 12 for comparison with the reference voltage $V_{pb}$ 59. In the event that the voltage across resistor 31 becomes substantially greater than the voltage (+/−) $V_{pb}$ 59, the LCMC 17 produces a drive signal 58 that alters the level of bias voltage supplied to the screen 12 by the bias supply 5 in a direction to impede the flow of the excessive positive or negative ions and accelerate the flow of the deficient positive or negative ions that upset the balance of ions in the air stream.

Figure 7:
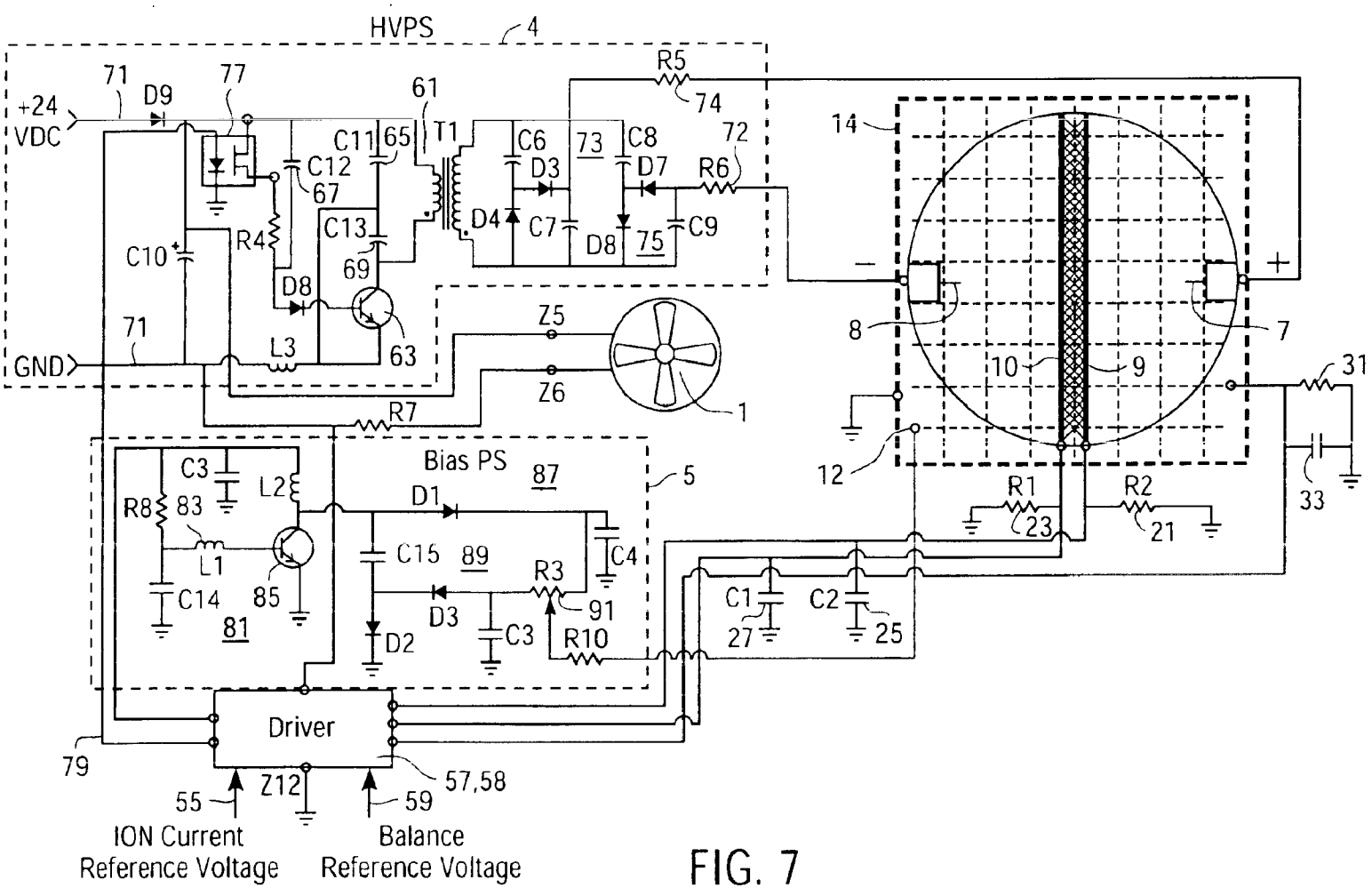
FIG. 7 is a detailed schematic diagram of the circuitry of FIG. 6 and of closed-loop circuitry for automatically controlling bipolar ionizing voltages.

Referring now to FIG. 7, there is shown a more detailed schematic diagram of the circuitry of the high voltage and bias supplies 4, 5 in accordance with one embodiment of the present invention. The high voltage power supply includes a Colpitts oscillator formed of the high-frequency transformer 61 and transistor 63 and capacitors 65, 67, 69. This oscillator runs on applied low voltage 71 to produce output pulses that are applied by the secondary winding of transformer 61 to the voltage doubler circuits 73, 75 which produce up to about ±8 kilovolts for application through current limiting resistors 72, 74 to the respective ionizing electrodes 7, 8. The secondary winding of transformer 61 is electrically isolated from ground by resistance of the order of $10^{12}$ ohms to assure self-balancing ion generation at the electrodes 7, 8 in the manner as previously described herein. The operating frequency of the oscillator is approximately 1 MHz, as determined substantially by the primary winding of transformer 61 and the capacitors 65, 69. The output voltage of the high voltage power supply 4 can be altered by modulating the duty cycle of oscillations at a low frequency of about 400–500 Hz. The modulating frequency is variable in response to the optically-controlled field-effect transistor 77 (or other electronically controlled resistor) that is connected in the base circuit of the oscillator transistor 63. In the event of change in the positive or negative ion current flowing to the septum electrodes 9, 10 and through the respective sampling resistors 21, 23 (or in the event of a change in a selected ratio of the positive and negative ion currents), the driver circuit 57, 58 alters the output 79 applied to the optically-controlled FET 77 to alter the duty cycle of the oscillations in a direction to restore the selected levels of ion current flowing to the septum electrodes 9, 10.

In similar manner, the bias supply 5 for supplying bias voltage to the screen 12 includes an oscillator 81 that operates on applied low voltage at a nominal frequency of about 1 MHZ, as determined by the inductor 83 connected in the base circuit, and by the internal collector-to-emitter capacitance of the transistor 85. The output pulses from the oscillator 81 are supplied to a half-wave rectifier 87 to produce positive voltage, and to a voltage doubler 89 to produce negative voltage. A selected proportion of the positive and negative output voltages is selected by resistor 91 for application to the screen 12. In the event the voltage drop across sampling resistor 31 becomes significantly different than the balance reference voltage 59, the driver 57, 58 alters the voltage 93 applied to the oscillator 81 in a direction to change the bias voltage applied to the screen 12 to restore the voltage drop across sampling resistor 31 to within tolerable limits of ion balance.

Figure 8:
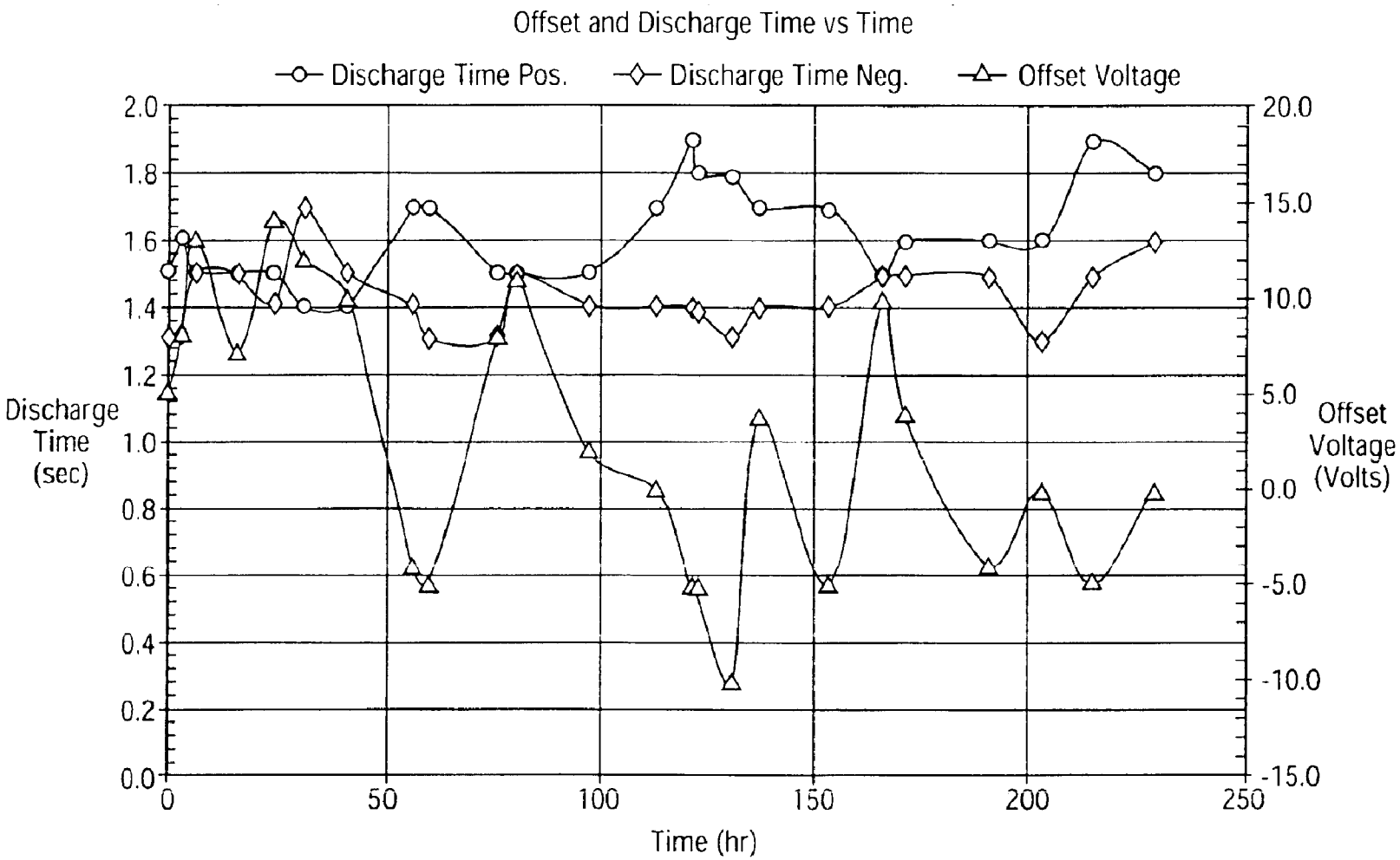
FIG. 8 is a graph illustrating the dependence of discharging efficiency and the offset voltages associated with operations of one embodiment of the present invention.

Referring now to the graph of FIG. 8, there is shown experimental data taken approximately every 10 hours over 230 hours of non-stop operation. Discharge Time Positive and Discharge Time Negative respectively correspond to actual time (sec.) taken to discharge an electrically-isolated 6"×6" metal plate from +1000V to +100V and from −1000V to −100V, at 4" distance. Offset voltage indicates actual readings (Volts) measured on the metal plate by the monitoring instrument, taken approximately every 10 hours of operation. These test data indicate that Discharge Time and Offset Voltage vary within a small range, affected substantially only by ambient environment changes, as very stable results produced by the present invention over long terms.

Figure 9:
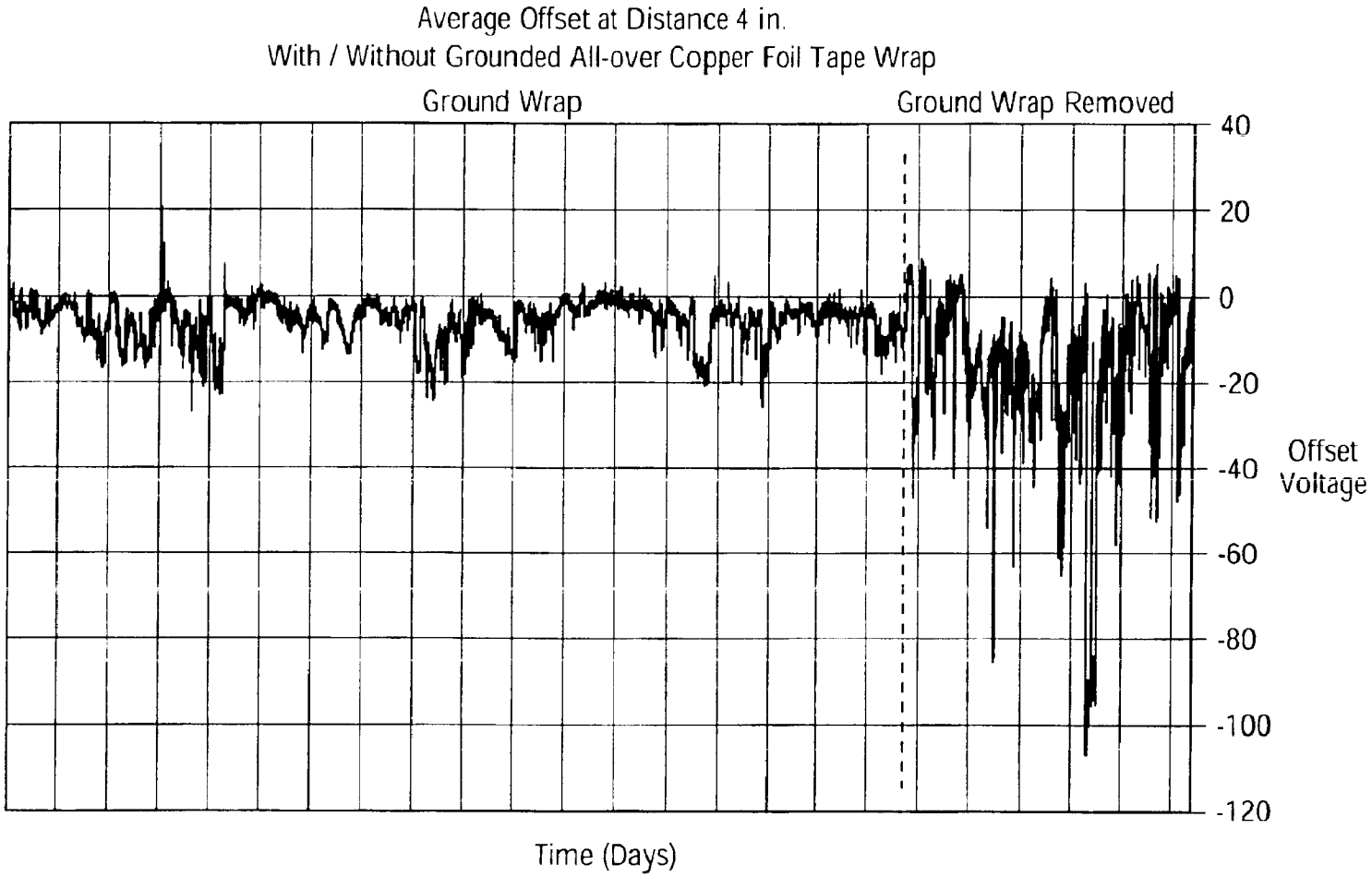
FIG. 9 is a graph illustrating offset voltages over long term on an object within close range of the ionizing apparatus of the present invention.

Referring now to the graph of FIG. 9, there is shown test data that illustrates positive effect on the magnitude of the voltage offset of a grounding conductive layer disposed about the device. The device generates ions which cause electric charge on surface of the plastic housing in the absence of a grounding layer, and such charge on plastic housing affects the electrical field of the grid 12. This causes arbitrary changes in the electrical balance on the grid. In contrast, the grounding shield decreases static charge on the housing, and electrical balance can be more readily established (as shown by the data prior to last six days). The grid 12 thus provides a significant level of balance control.

Therefore, the air ionizing apparatus of the present invention generates positive and negative air ions under close controls of production levels and balance to facilitate closely-directed charge neutralization of an electrostatically charged object. Small packaging of the apparatus promotes convenient mounting on a robotic transporter of semiconductor wafers to direct a balanced stream of positive and negative air ions toward a charged wafer.

What is claimed is:

1. Air ionization apparatus comprising:

a duct including a fan disposed near an inlet thereof for moving air from the inlet toward an outlet;

a pair of ionizing electrodes disposed near the outlet in substantially inward orientations from opposite walls of the duct;

septum electrodes disposed in transverse orientation between walls of the duct near the outlet thereof, and oriented substantially normally to the ionizing electrodes, the septum electrodes including a pair of substantially planar conductive layers spaced apart by a layer of electrical insulation therebetween;

sources of positive and negative ionizing voltages electrically isolated from ground and connected to respective ones of the pair of ionizing electrodes; and circuits communicating with the septum electrodes for separately sensing currents to ground in the septum electrodes associated with transfers of ions from respective ionizing electrodes.

2. Air ionization apparatus according to claim 1 including a grid electrode disposed over the outlet of the duct and electrically isolated from ground; and a source of bias voltage connected to supply bias voltage to the grid electrode relative to ground.

3. Air ionization apparatus according to claim 1 in which the circuits include resistors connected between ground and respective ones of the septum electrodes; and monitoring circuitry connected to sense voltages across the resistors for producing an output representative of a voltage across a resistor attaining a selected level.

4. Air ionization apparatus according to claim 2 including a resistor connecting the source of bias voltage to ground; and monitoring circuitry connected to sense voltage across the resistor for producing an output indicative of the sensed voltage attaining a selected value.

5. Air ionization apparatus according to claim 3 in which the monitoring circuitry responds to the difference of the sensed voltages attaining a selected value for producing said output.

6. Air ionization apparatus according to claim 4 in which the monitoring circuitry responds to the sensed voltage attaining a selected level relative to ground potential.

7. Air ionization apparatus according to claim 3 in which the monitoring circuitry communicates with at least one of the sources of positive and negative ionizing voltages for altering the level of the ionizing voltage produced thereby in response to said output in a direction toward equalizing the sensed voltages.

8. Air ionization apparatus according to claim 7 in which the monitoring circuitry communicates with the sources of positive and negative ionizing voltages for altering the levels thereof in response to said output in a direction toward equalizing the sensed voltages.

9. Air ionization apparatus according to claim 4 in which the monitoring circuitry communicates with the source of bias voltage to alter the level thereof supplied to the grid electrode in response to said output in a direction toward a selected value.

10. Air ionization apparatus as in claim 1 in which the duct includes an electrically insulated interior wall and includes an electrically conductive grounded exterior.

11. Air ionization apparatus according to claim 1 in which the septum electrodes are substantially aligned in plane-parallel orientation along the direction of air flow from the fan.

12. Air ionization apparatus according to claim 2 including a resistor connecting each septum electrode to ground, and including a resistor connecting the source of bias voltage to ground;

monitoring circuitry connected to receive the voltages appearing across each of the resistors relative to ground, and communicating with the sources of positive and negative ionizing voltage and with the source of bias voltage for altering the levels of at least one of the positive and negative ionizing voltages, and for altering the level of bias voltage in directions to provide substantially balanced levels of positive and negative ions flowing through the grid electrode in a flow of air from the fan.

13. A method of producing controlled amounts of positive and negative air ions in an air stream, the method comprising:

forming positive air ions and negative air ions in electrically isolated separate portions of the air stream;

sensing rates of production of positive and negative ions in the air stream;

altering the rate of production of at least one of the positive and negative air ions in response to the sensed rate of air ion production of the at least one thereof relative to a selected rate;

sensing the positive and negative ions flowing in the air stream; and electrostatically altering the flow of positive and negative ions in the air stream toward substantial equality in response to the sensed air ions flowing in the air stream.

14. The method according to claim 13 in which the positive and negative air ions are formed in regions of the air stream in response to ionizing voltages supplied between ionizing electrodes and electrically separated, substantially planar electrodes that are aligned along the air stream, the method comprising:

sensing ion current flowing in each of the planar electrodes; and altering at least one of the ionizing voltages to alter the rate of production of ions therefrom in a direction toward equalized production rates.

15. The method according to claim 13 in which ions in the air stream flow through an electrically conductive grid; and the method includes altering voltage on the conductive grid to electrostatically alter the flow of positive and negative ions flowing therethrough.

* * * * *

UNITED STATES PATENT AND TRADEMARK OFFICE

CERTIFICATE OF CORRECTION

PATENT NO. : 6,850,403 B1
DATED : February 1, 2005
INVENTOR(S) : Peter Gefter et al.

It is certified that error appears in the above-identified patent and that said Letters Patent is hereby corrected as shown below:

Title page,
Item [56], References Cited, U.S. PATENT DOCUMENTS, please delete "3,137,808" and replace with -- 3,137,806 --.

Signed and Sealed this

Tenth Day of May, 2005

JON W. DUDAS
*Director of the United States Patent and Trademark Office*